US005522195A

United States Patent [19]

Bargen

[11] Patent Number: 5,522,195

[45] Date of Patent: Jun. 4, 1996

[54] ENERGY-EFFICIENT FIRE DOOR

[76] Inventor: Theodore J. Bargen, 8615 W. Park, Lynden, Wash. 98264

[21] Appl. No.: 153,123

[22] Filed: Nov. 15, 1993

[51] Int. Cl.[6] ..... E06B 3/70

[52] U.S. Cl. ..... 52/455; 52/309.9

[58] Field of Search ..... 52/455, 457, 785, 52/809, 829, 806, 309.9; 49/171, 501; 428/920, 921

[56] References Cited

U.S. PATENT DOCUMENTS

| | | | |
|---|---|---|---|
| 4,811,538 | 3/1989 | Lehnert et al. | 52/455 |
| 5,022,206 | 6/1991 | Schield et al. | 52/455 |

OTHER PUBLICATIONS

Photocopy of p. 363 of American Heritax's Dictionary.

*Primary Examiner*—Creighton Smith
*Attorney, Agent, or Firm*—Hughes, Multer and Schacht

[57] ABSTRACT

An energy-efficient, wood-skinned fire door having a laminate construction. There is a core panel formed of a fire-resistant material, preferably mineral fiber board. The perimeter frame around this has a channel formed in its inner edge for receiving the core panel in a close interfit therewith. This supports the panel in the channel, and also eliminates any direct path for a fire to proceed past the edge of the fire-resistant panel. Foil-covered thermal insulation panels are positioned on opposite sides of the core panel, and these are covered with wooden door skins. This provides a structure which is highly fire resistant and exhibits excellent insulation qualities, yet which is also aesthetically pleasing so as to be suitable for residential use.

13 Claims, 2 Drawing Sheets

ENERGY-EFFICIENT FIRE DOOR

FIELD OF THE INVENTION

The present invention relates to doors for dwellings and similar structures, and more particularly, to a wood-skinned fire-resistant door which exhibits good thermal insulation qualities so as to be suitable for use as an exterior door in residential construction.

BACKGROUND OF THE INVENTION

The benefits of fire-resistant doors (sometimes referred to hereinafter as "fire doors") have long been recognized. For safety purposes, these are frequently required by building codes, especially for commercial and institutional structures. For example, fire doors are frequently specified for interior doors of hotels, hospitals, schools, and so forth.

In the past, such fire doors have ordinarily been constructed of metal. This material has been satisfactory for commercial and institutional installations, but there has been an increasing movement to specify fire doors for residential construction, in order to translate their benefits into the home. For example, it is becoming common to require installation of a fire door between the interior of a house and an attached garage, because of the likelihood of a fire arising in the latter. However, the metal construction of traditional fire doors, particularly the metal door skins, is generally considered unacceptable for home use from the standpoint of aesthetics, being that wood-skinned doors are greatly preferred by residential customers.

There have been attempts to provide wood-skinned fire doors, but the requisite resistance to burn-through has generally been achieved at the expense of costly construction and poor thermal insulation qualities. For example, some doors have been built around an expensive solid slab of fire-resistant mineral material which extends the full thickness of the door, and which possesses poor insulation qualities. Other approaches have generally had the disadvantages of complex and expensive construction, and sometimes severely compromised fire-resistant qualities. An example of this is the door construction shown in U.S. Pat. No. 4,282,687 (Teleskivi). In this construction, there is a door having an outer frame made up of edge timbers with a subframe being constructed within this. The subframe is built up from a number of metal members having a Z-shaped cross section. These crisscross both faces of a central panel made of glass fiber reinforced gypsum sheet, and are held together by screws 16 which pass through this. The outer flanges of the Z-shaped members support a door skin made of fiberboard and wood veneer, and layers of mineral fiber compressed bats 22 are positioned between these skins and the central core.

In short, while the approach which has been taken by Teleskivi may represent an advance in some respects, the results are far from satisfactory in practice. Firstly, constructing the subframes from numerous metal members represents a laborious and costly process. Also, the metal frameworks lying on opposite sides of the gypsum core are connected through this by the metal securing screws, and these represent an uninterrupted conduction path for the transmission of thermal energy; it would therefore appear likely that a fire on one side of the door would quickly destroy the veneer and pressboard skin to reach the first metal framework, and then the heat would be conducted via this and the connecting screws to the opposite framework, setting the opposite skin ablaze. As for the mineral fiber bats, the thermal insulation offered by these would appear to be marginal at best. Moreover, simply from the standpoint of long-term durability, the structure appears to rely largely on the built-up metal framework, and this would be susceptible to flexing and working loose over many years of use, especially where the metal strips engage the outer framework of the door.

Accordingly, a need exists for an energy-efficient fire door having a construction such that this is suitable for use as an exterior door in a residential structure, which exhibits superior fire resistant qualities, and which has a high insulation factor so as to minimize energy waste due to heat loss. Furthermore, there exists a need for such a door which is simple and inexpensive to construct, which is very durable in order to meet the requirements of long-term residential use, and which also presents an aesthetic aspect which is suitable for such applications.

SUMMARY OF THE INVENTION

The present invention has solved the problems cited above, and is an energy-efficient fire door having a laminate construction. Broadly, this comprises: (a) a core panel formed of a fire-resistant material; (b) a frame which defines a perimeter of the door, this having a channel for receiving an edge of the core panel in a close interfit therewith, so that the panel is supported by the frame in the channel, and so that this interfit eliminates any direct path for a fire around the edge of the fire-resistant panel; (c) first and second layers of a thermal insulation material positioned on opposite sides of the core panel so as to reduce the transfer of thermal energy through the door; and (d) first and second wooden door skins mounted on opposite sides of the frame so as to extend over the layers of thermal insulation.

Preferably, the core panel may comprise a planar sheet of fire-resistant mineral fiber board. The frame, in turn, may preferably comprise first and second stile members which extend parallel to one another so as to form vertical side edges of the door, and first and second rail members which extend parallel to one another so as to form horizontal top and bottom edges of the door. These stile and rail members are preferably formed of lumber.

The channel in the frame may preferably be formed by a dado cut in each of the stile and rail members, these being joined together with the dado cuts aligned so that the channel extends continuously around the perimeter of the door. The fire-resistant panel may be approximately ½ inch thick, and the dado which is cut in the frame members for this may preferably be about ½ inch wide and at least ½ inch deep, so that there is an overlap of at least ½ inch on both sides of the edge of the core panel which eliminates any direct path for a fire past this.

The layers of insulation material may comprise an insulating foam material, and there may preferably be a metal foil sheet over each face of the foam layers for providing a flame barrier and also for reflecting back at least a portion of the thermal energy which is transmitted into the door. As for the foam material itself, this may preferably be a polyisocyanurate foam material. Preferably, with a ½ inch thick core panel, the stile and rail members are approximately 1½ inches thick front to back, with the dado located centrally in the inner edges thereof, so that the door skins which are mounted to the outer faces of the members define a ½-inch thick cavity on each side of the core panel which is filled with the polyisocyanurate insulating foam.

DETAILED DESCRIPTION a. Overview

Figure 1:
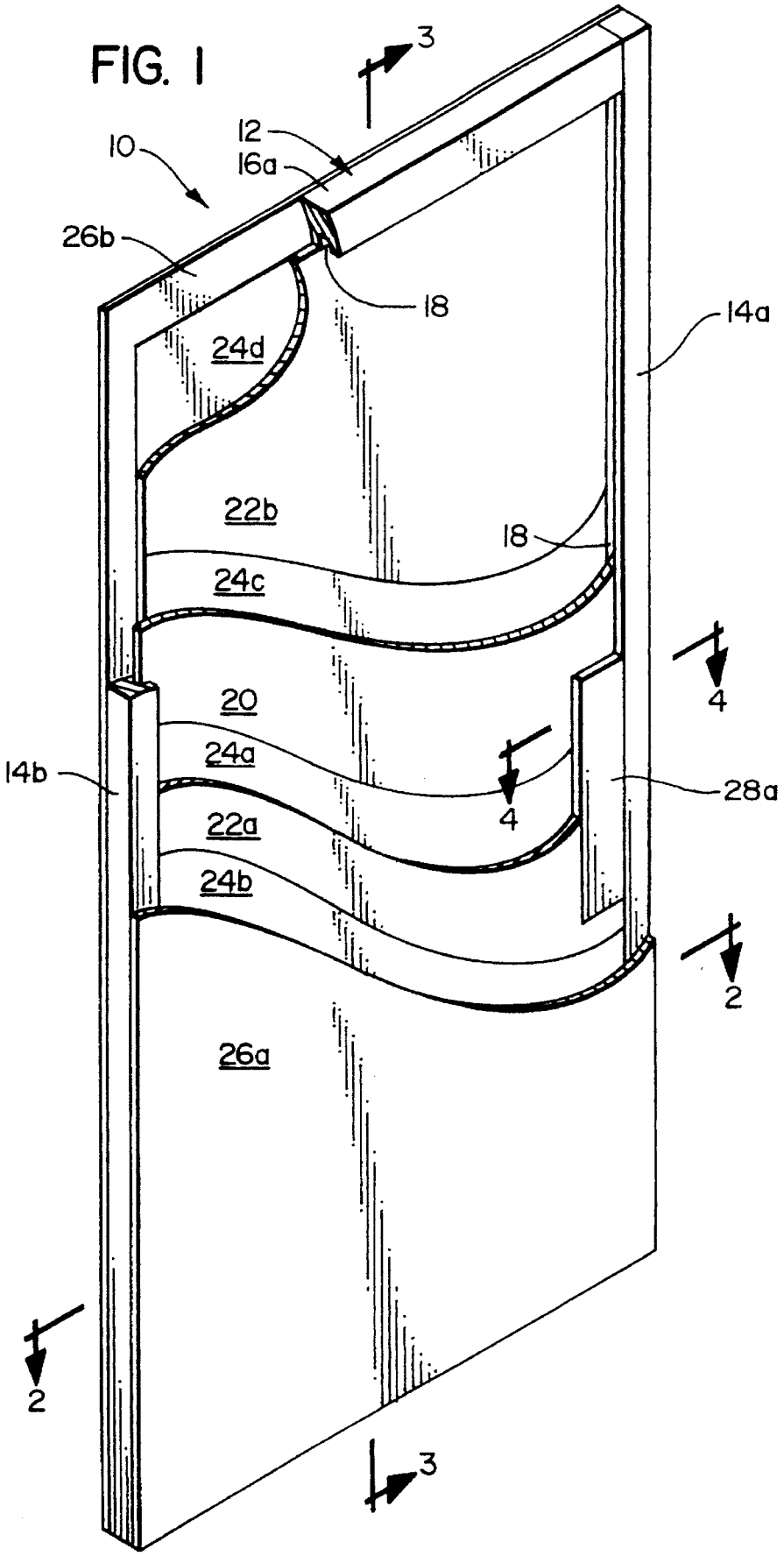
FIG. 1 is a perspective view of an energy-efficient fire door constructed in accordance with the present invention, this being shown partially cut away to reveal the fire-resistant core and layers of insulation material, as well as the perimeter rails which support these and impart rigidity to the structure.

An overview of a door constructed in accordance with the present invention will be provided with reference to FIG. 1, before proceeding to a more detailed description of a number of its individual components. Accordingly, FIG. 1 shows a fire door 10 which is sized to fit a door frame in a house or other structure, and which may be constructed to fit a standard-size door frame, or may be custom-made for a particular opening.

The principle structural member of the door is a perimeter frame 12. This is rectangular in configuration, and is made up generally of vertically extending stiles 14*a*, 14*b* (see also FIG. 2) and horizontally extending top and bottom rails 16*a*, 16*b*. A dado is cut in the inner edge of each of these members so as to form a continuous perimeter channel 18 which receives the edge of the fire-resistant core panel 20. As will be described in greater detail below, the depth of the channel relative to the thickness of the core panel is important in providing the fire resistance advantages of the present invention. This also provides a very sturdy and durable structure which is simple and inexpensive to fabricate.

The fire-resistant core panel 20 is sandwiched between front and rear layers 22*a*, 22*b* of insulation material, which are principally responsible for the thermal insulation qualities of the door. The materials of which these layers and the core panel are made will be described in greater detail below.

To augment the thermal insulation qualities of layers 22*a* and 22*b*, and also to provide these with a flame shield, inner and outer sheets of reflective metal foil 24*a,b* and 24*c,d* are layered against the surfaces of each of these members. Overlying the outer foil sheets, in turn, are the outer door skins 26*a*, 26*b*. These are preferably made of plywood or other suitable material, with a wood veneer or similar finish on their outer surfaces so as to present an aesthetically pleasing aspect.

Figure 4:
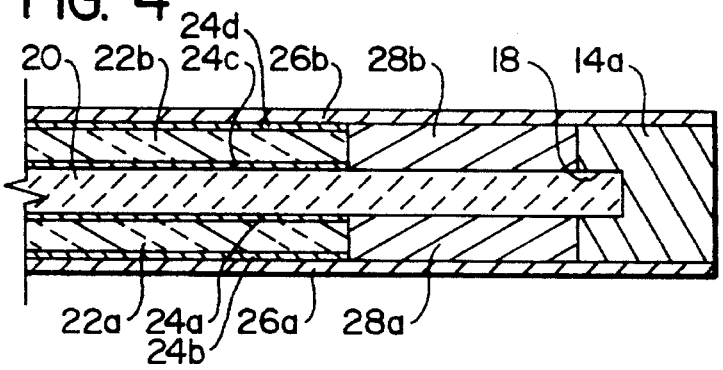
FIG. 4 is an end view, looking vertically, of a section taken through the right-hand side of the door of FIG. 1, along line 4—4, showing the lock block assembly which is provided therein for the mounting of a door knob and lock mechanism.
Figure 3:
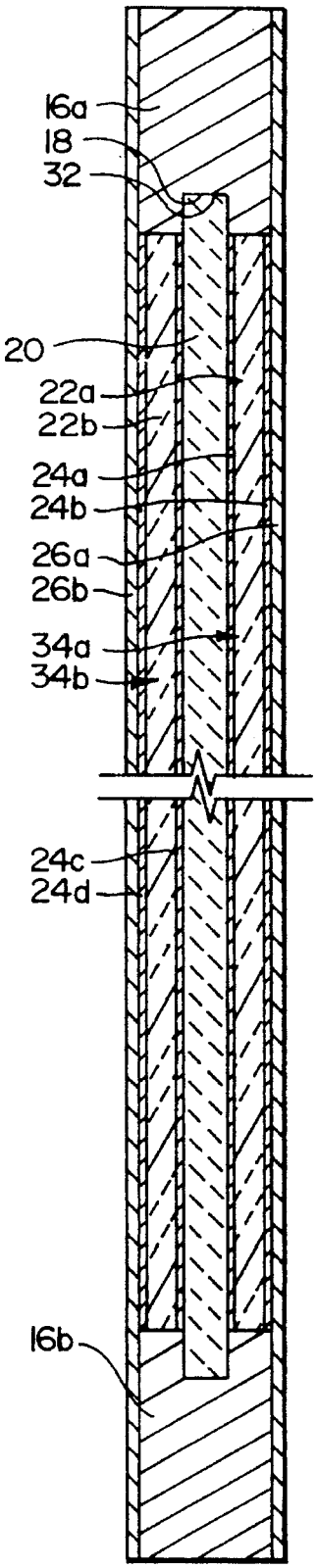
FIG. 3 is a end view, looking laterally, of a section taken along line 3—3 through the door of FIG. 1.

Also, at one edge of the door, there are a pair of lock blocks 28*a*, 28*b* (see also FIG. 4). These provide a mounting and support area for the door lock mechanism and the associated door knob; as will be described in greater detail below, these are preferably mounted on both sides of the core panel 20, and adjacent to the vertical stile which forms the edge of the door.

b. Framework

Figure 2:
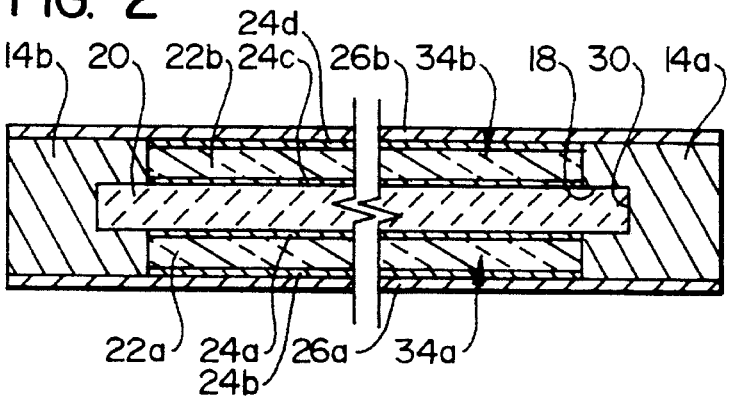
FIG. 2 is an end view, looking vertically, of a section taken along line 2—2 through the bottom portion of the door of FIG. 1.
Figure 2A:
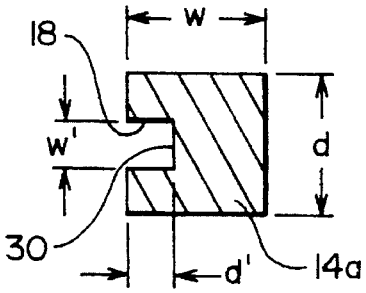
FIG. 2A is a detail view of the door stile which appears at the right-hand side of FIG. 2, this being one of the members which make up the outer framework of the assembly.

Having provided an overview of the door construction of the present invention, a number of aspects of this will now be described in greater detail. Turning then to FIG. 2, this shows the manner in which the stiles 14*a*, 14*b* engage and support the fire-resistant core panel 20.

As was described above, these stiles are wooden members which extend vertically along the edges of the door. Each has a dado 30 cut in its inner edge to form a part of the perimeter channel 18, and this is sized to receive an edge of the core panel. As noted above, it has developed that the depth of this cut is important from the standpoint of both fire resistance and structural integrity of the finished door. For example, in a preferred embodiment, the core panel is formed of ½ inch thick mineral fiber board material. The dado 30, in turn, is cut ½ inch wide to receive the edge of this panel in a close interfit therewith, and is also preferably at least ½ inch deep. The reasons for this are twofold. Firstly, this provides a relatively great engagement area between the panel and the stiles (and rails) of the perimeter frame, so as to provide the structure with greater rigidity and long-term durability. Moreover, it has been found that the joint creates a U-shaped path (as seen in cross section) which a fire must traverse before it is able to reach the opposite side of the door. In other words, in the event that a fire burns through the skin and insulation layer on one side of the door, its direct path will be blocked by the fire-resistant core, and it must work its way through the elongate and indirect path around the edge of this in order to reach the opposite side, with the result that its progress will be significantly delayed. The stiles themselves, in turn, are formed of relatively dense solid wood (which may also be treated for fire resistance in some embodiments), and so these are also very resistant to burn through.

The stiles also provide support for the spaced-apart door skins. In an exemplary embodiment, the stiles may have the following cross sectional dimensions:

| | |
|---|---|
| Depth (d) (between skins) | 1 1/2 inch |
| Width (w) | 1 3/4 inch |
| Width of Dado (w') | 1/2 inch |
| Depth of Dado (d') | 1/2 inch |

The 1¾ inch width listed above gives a ¼-inch margin for trimming in finishing the door or fitting it to a frame, while still leaving a finished stile which is approximately 1½ inches wide so as to provide adequate structural support for the skins and core panel. These stiles may be formed of any suitable wood, or even possibly a synthetic substitute for wood, but it should be noted that wood having the density of white fir or greater has been found particularly desirable in terms of fire resistance and strength.

Figure 3A:
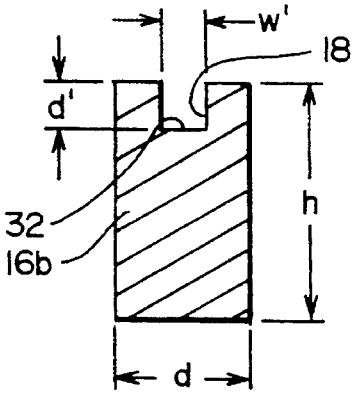
FIG. 3A is a detail view of the bottom rail of the door, as seen in the lower portion of FIG. 3, this being another of the structural members of the frame.

FIG. 3A shows the same detail for the upper and lower door rails. These are generally similar to the stiles and their overall configuration, but are somewhat larger owing to the heavier loads which they must be able to carry. Again, a dado 32 is cut into the inner edge of each of these to form a part of the perimeter channel 18, and this is again preferably ½ inch wide and at least ½ inch deep. Cross-sectional dimensions for the rails of an exemplary embodiment are as follows:

| | |
|---|---|
| Depth (front to back) | 1 1/2 inches |
| Height (before trimming) | 2 5/8 inches |
| Dado Width | 1/2 inch |
| Dado Depth | 1/2 inch |

Also, the rails are preferably made of the same wood material as the stiles of the perimeter frame. The rails and stiles may be joined together by any suitable means, such as by gluing, stapling, nailing, for example.

c. Fire-Resistant Core

As noted above, the fire-resistant core panel is preferably formed of mineral fiber board. A specific material which has been found highly advantageous for this application is that which can be obtained from U.S.G. Interiors, Inc., Thermafiber Division, Chicago, Ill., under the trade name Micore™ 160. This material is manufactured from inorganic mineral fibers, expanded perlite, and binder materials. It is lightweight and very strong for a product of its nature, and exhibits good thermal insulation qualities and is highly resistant to burn-through. Moreover, it retains these qualities when supplied in the standard ½ inch thicknesses described above. The strength and rigidity of this material is such that, when supported in the perimeter channel in the stiles and rails described above, there is no need for any additional bracing or framework of any kind across the main panel of the door, even though its width and height may be 36 by 84 inches or greater. This arrangement much simplifies the construction of the door, and also avoids the problem of heat transfer through a framework or fasteners which might otherwise need to be installed in the panel.

Although the Micore™ 160 material is thus eminently suitable for use as the fire resistant core panel in doors constructed in accordance with the present invention, it will be understood that other suitable fire resistant panel materials will occur to those skilled in the art.

d. Insulation Layers and Skin

As was noted above, the door skins 26*a* and 26*b* are mounted to the outer faces of the stiles and rails of the perimeter frame, so that these are spaced outwardly from the fire-resistant core panel 20. Cavities 34*a*, 34*b* are consequently formed on either side of the core panel, and these cavities are filled with the insulation layers 22*a*, 22*b*.

The insulation layers may be formed of any suitable insulation material, which may be in the form of rigid panels, batting, foamed-in-place material, and so forth. Foam panels have been found to be an eminently suitable insulation material for this application, being that these exhibit excellent thermal insulation qualities and are very easy to cut and handle in an assembly operation. An example of a suitable material of this type is that available from Atlas Energy Products, a Division of Atlas Roofing Corporation, Atlanta, Ga., under the trade name ACFoam Supreme. This is formed of a urethane foam material, specifically, a polyisocyanurate foam. It will be understood from the dimensions given above that the two layers 22*a*, 22*b* of this material are suitably about ½ inch thick.

The inner and outer metal foil sheets 24*a,b* and 24*a,c* cover the surfaces of the foam inserts 22*a*, 22*b*. The principal purpose of these is to reflect thermal energy so as to prevent its transmission through the door, thereby enhancing the insulation qualities of the structure. Also, the foil sheets serve as flame shields which help protect the foam material once the door skin has been penetrated, and then protect the core panel after the foam has deteriorates. The foil material itself may be any of the various foils, mostly metallic, which are suitable for reflecting thermal energy, as are well known to those skilled in the art; in the case of the Atlas ACFoam Supreme material described above, the foil sheets are formed as an integral part of the product, which greatly simplifies the assembly process.

Finally, the outermost layers of this "sandwich" construction are provided by the two door skins 26*a*, 26*b*. These overlie and enclose the insulation material in the two cavities 34*a* and 34*b*. The door skins are ordinarily rectangular in shape (although other shapes may be provided), and each of their four edges is mounted to the perimeter frame 12; this may be done in any suitable fashion, although adhesive bonding is generally preferred over the use of metal fasteners, to eliminate the possibility of the latter providing conduction paths into the interior of the lumber.

As for the door skins themselves, these may be formed of any suitable material which is provided with a wood, simulated wood, or similar, aesthetically pleasing outer face. For example, these may suitably be formed of plywood with a veneer surface, although in some applications a hardboard with or without an overlay, or a vinyl or plastic veneer may be preferred; as used in this description and the appended claims, the term "wooden" when used with respect to these skins includes those and other suitable materials formed of wood or having a wood-like character, as well as solid wood panels. It has been found that a suitable thickness for these panels is approximately ⅛ inch, being that these are sufficiently durable for long-term service, but are also relatively economical and light in weight.

e. Lock Blocks

As noted above, the lock blocks provide a mounting area for the lock mechanism and door knob. As such, these need to provide relatively solid support, and accordingly are preferably formed of solid wood. There are two of these, one on each side of the core panel 20, and they are mounted against and partway along the length of the stile at the edge of the door. The blocks are preferably about ½ inch thick, so as to fit tightly between the core panel and the door skins, providing support against the back side of the latter. As shown, the lock blocks are preferably rectangular in shape, with dimensions of about 3 inches wide by 20 inches long having been found suitable. Preferably, these are mounted a distance above the bottom edge of the door such that the door knob will be positioned at a conventional height when the lock mechanism is installed therein.

f. Performance

Doors having the foregoing construction have undergone extensive testing, and the results have borne out the advantages of the present invention: they exhibit superior resistance to burn through by fire, as well as excellent thermal insulation qualities.

For example, doors constructed in accordance with the present invention have successfully satisfied fire endurance and hose stream testing requirements for rating as a 20-minute fire door in accordance with the following United States and Canadian standards: ASTM E=152, CSFM 43.7, NFPA 252, UBC-43.2, CAN-S104, and UL 19(b).

In actual testing, it has been found that the wooden outer door skins deteriorate fairly rapidly in a fire, but then the progress of the fire is initially checked by the metal foil sheets. When these and the foam insulation have burned away, the fire resistant core panel 20 confronts the fire, this being the principal fire resistant component of the structure. Being that this consists mainly of a non-combustible mineral fiber matrix, the fire simply will not be able to burn through the core panel, even over an extended period of time. The only other paths to the opposite side of the door are through the solid wood rails and stiles at the frame edges, or through the very confined U-shaped passages around the edges of the core, and both of these paths are very resistant to the progress of the fire: in testing, it has been found that it ordinarily takes the fire well in excess of twenty minutes to burn through these routes, even at furnace temperatures reaching 800° C. Furthermore, even after such charring, the door structure has been found to exhibit relatively little warpage, and the mineral fiber core panel remains strong enough to withstand a stream of water from a 2½-inch hose (simulating fire-fighting water) and still remain intact.

Similarly, fire doors having the construction of the present invention have successfully met established energy efficiency criteria for residential installation; for example, these have surpassed the requirements of the State Energy Codes of both Washington and Oregon. Testing of one embodiment constructed as described above (using ACFoam Supreme™ insulation panels) established a coefficient of heat transmission of 0.20 Btu/Hr/ft$^2$/°F. (test method—AAMA 1503.1–88), yielding a thermal resistivity value of R5. The actual resistivity value can be adjusted to a degree by selection of the insulation material, giving particular regard to its density.

Moreover, testing has demonstrated that fire doors having a construction in accordance with the foregoing are highly durable and hard-wearing in use, and they present a pleasing aesthetic aspect. Accordingly, the present invention has overcome the drawbacks which were exhibited by both metal and wooden fire doors of the past.

The invention may be embodied in other specific forms without departing from the spirit or essential characteristics thereof. For example, if so desired, the door could be made up of a plurality of panels having the construction described above rather than as a single panel. Also, the door could be constructed to have various shapes in addition to the conventional rectangular configuration described above. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. An energy-efficient fire door having a laminate construction, said door comprising:

a core panel formed of a fire-resistant material;

a frame which defines a perimeter of said door, said frame having a channel for receiving an edge of said core panel in a close interfit therewith, so that said panel is supported by said frame in said channel, and so that said interfit of said panel within said channel eliminates any direct path for a fire past said edge of said fire-resistant panel;

first and second layers of a thermal insulation material positioned on opposite sides of said core panel so as to reduce transfer of thermal energy through said door, said first and second layers of thermal insulation material being a urethane foam material;

first and second wooden door skins mounted on opposite sides of said frame so as to extend over said layers of thermal insulation material.

2. The fire door of claim 1, wherein said core panel comprises:

a planar sheet of fire-resistant mineral fiber board.

3. The fire door of claim 2, wherein said frame comprises:

first and second stile members extending parallel to one another so as to form vertical side edges of said door; and first and second rail members extending parallel to one another so as to form horizontal top and bottom edges of said door.

4. The fire door of claim 3, wherein said sheet of mineral fiber board is approximately ½ inch thick.

5. The fire door of claim 4, wherein said stile members and said rail members are formed of lumber.

6. The fire door of claim 5, wherein said channel is formed by a dado cut in each of said stile members and rail members, said members being joined together with said dadoes aligned so that said channel extends continuously around said perimeter of said door.

7. The fire door of claim 6, wherein said dado is cut about ½ inch wide and at least ½ inch deep, so that there is an overlap of at least ½ inch on both sides of said edge of said core panel which eliminates said direct path for said fire.

8. The fire door of claim 4, wherein said insulation material comprises an insulating foam material.

9. The fire door of claim 1, wherein said urethane foam material is a polyisocyanurate foam material.

10. The fire door of claim 9, wherein said stile members and said rail member are approximately 1½ inches thick front to back, and said dado is located centrally in inner edges thereof, so that said door skins mounted on said outer faces of said members define with said core panel a cavity approximately ½ inch thick which is filled with said insulating polyisocyanurate foam material.

11. The fire door of claim 1, further comprising sheets of reflective metal foil positioned over surfaces of each of said layers of insulating foam material so as to reflect back at least a portion of said thermal energy transmitted into said door.

12. An energy-efficient fire door having a laminate construction, said door comprising:

a core panel formed of a fire-resistant material;

a frame which defines a perimeter of said door, said frame having a channel for receiving an edge of said core panel in a close interfit therewith, so that said panel is supported by said frame in said channel, and so that said interfit of said panel within said channel eliminates any direct path for a fire past said edge of said fire-resistant panel;

first and second layers of a thermal insulation material positioned on opposite sides of said core panel so as to reduce transfer of thermal energy through said door, said first and second layers of insulating material being a polyisocyanurate foam material;

first and second wooden door skins mounted on opposite sides of said frame so as to extend over said layers of thermal insulation material; and sheets of reflective metal foil positioned over surfaces of each of said layers of insulating foam material so as to reflect back at least a portion of said thermal energy transmitted into said door.

13. The fire door of claim 12, wherein said stile members and said rail member are approximately 1½ inches thick front to back, and said dado is located centrally in inner edges thereof, so that said door skins mounted on said outer faces of said members define with said core panel a cavity approximately ½ inch thick which is filled with said insulating polyisocyanurate foam materials.

* * * * *